US007520962B2

(12) United States Patent
Muench et al.

(10) Patent No.: US 7,520,962 B2
(45) Date of Patent: Apr. 21, 2009

(54) MACHINE FOR PRODUCING A FIBROUS WEB

(75) Inventors: Rudolf Muench, Koenigsbronn (DE); Egon Bild, Meerbusch (DE); Siegfried Daum, Hilden (DE); Joerg Maurer, Steinheim (DE); Tobias Wanke, Steinheim (DE); Werner Reichert, Frickingen (DE); Wolfgang Klotzbuecher, Gerstetten (DE); Josef Wigand, Herbrechtingen (DE)

(73) Assignee: Voith Paper Patent GmbH, Heidenheim (DE)

( * ) Notice: Subject to any disclaimer, the term of this patent is extended or adjusted under 35 U.S.C. 154(b) by 447 days.

(21) Appl. No.: 11/175,136

(22) Filed: Jul. 7, 2005

(65) Prior Publication Data

US 2006/0076119 A1 Apr. 13, 2006

(30) Foreign Application Priority Data

Jul. 8, 2004 (DE) ..... 10 2004 033 236

(51) Int. Cl.
*D21F 7/06* (2006.01)

(52) U.S. Cl. ..... 162/263; 162/194; 162/198; 162/286

(58) Field of Classification Search ..... 162/263, 162/286, 194, 198
See application file for complete search history.

(56) References Cited

U.S. PATENT DOCUMENTS

| | | | | |
|---|---|---|---|---|
| 6,299,730 | B1 * | 10/2001 | Broek et al. | 162/198 |
| 2003/0083765 | A1 | 5/2003 | Nonaka | |
| 2005/0096869 | A1 | 5/2005 | Drager et al. | |

FOREIGN PATENT DOCUMENTS

| | | |
|---|---|---|
| DE | 10121775 | 11/2002 |
| DE | 10253822 | 5/2004 |
| DE | 10306269 | 8/2004 |
| EP | 1524614 | 4/2005 |

* cited by examiner

*Primary Examiner*—Mark Halpern
(74) *Attorney, Agent, or Firm*—Greenblum & Bernstein, P.L.C.

(57) ABSTRACT

Machine for producing a web includes a system for predefining a quantity of a grade to be produced utilizing a measuring arrangement for measuring quality data during production of the web. The system defines the quantity of the grade to be produced by using data measured by the measuring arrangement during the production of the web.

21 Claims, 2 Drawing Sheets

MACHINE FOR PRODUCING A FIBROUS WEB

CROSS-REFERENCE TO RELATED APPLICATIONS

The present application claims priority under 35 U.S.C. §119 of German Patent Application No. 10 2004 033 236.3, filed on Jul. 8, 2004, the disclosure of which is expressly incorporated by reference herein in its entirety.

BACKGROUND OF THE INVENTION

1. Field of the Invention

The invention relates to a machine for producing various grades of a paper, board, tissue or of another web material, having a system for predefining the quantity of a grade to be produced.

2. Discussion of Background Information

DE 101 21 775 A1 discloses a method and apparatus for calibrating consistency sensors. During the production of a fibrous web, in particular, a paper or board web, sensors are used to measure the consistencies of the fibrous stock suspensions needed for the production process. According to the known system, the consistency sensors are calibrated online and automatically. In this case, the actual consistency values can be determined from the measured consistency values obtained, by means of at least one mass balance and by means of sensor characteristics. In one embodiment of the known system, use is also made of a consistency sensor which supplies the initial basis for the calibration of the other consistency sensors. Such a consistency sensor for measuring the actual consistency is, for example, a sensor for determining the grammage or the dry weight of the paper web after the latter has run through a press.

Enterprise Resource Planning (ERP) systems, which are widespread nowadays, take no account of electronic quality data or web inspection data which are measured during the production operation, that is to say online, which provide indications on defects or holes in the fibrous web. Therefore, it is not possible to make any predefinitions as to how much of one grade of a fibrous web should be produced.

Instead, the production planning is carried out in the following way: The ERP system predefines how much of a specific grade is needed. This target variable is then used as a target variable on the paper machine. The production management can increase this target variable in order to take account of the fact that part of the production may become broke on account of process fluctuations or defects. The finished parent reels, wound with the paper web, are transported from the paper machine to a slitter-rewinder. There, the parent reels are cut in accordance with the predefinitions and requirements of the final customers. Defects and other broke are cut out. In this case, quality measurements which were carried out on the paper machine are used to find the broke locations. By means of this procedure, the hope is to have produced sufficient to wind the quantity of "good production" required by the ERP system onto rolls determineed for the final customers, in spite of the broke produced. If this is not successful, a small quantity of paper has to be produced subsequently, which entails considerable additional costs because of the grade change times in the paper machine.

SUMMARY OF THE INVENTION

The invention improves the machine in such a way that the subsequent production of paper can be avoided.

According to the invention, in a machine of the type mentioned at the beginning, the system comprises a measuring arrangement for measuring quality data during the production of the fibrous web, and that, by using the data measured by the measuring arrangement during the production, the system defines the quantity of the grade to be produced.

Thus, by using the measured quality data, the ERP system determines the necessary production online. The necessary production P is composed of the necessary good production G, the broke A including the trim and a reserve R, so that:

$$P=G+A+R$$

The invention therefore registers the broke during the production so that the production can be changed online by the ERP system. Here, the aim is that the good production is achieved after the passage through the slitter-rewinder and the reserve can be kept as small as possible.

The invention can be applied not only to fibrous webs but quite generally to other web materials.

Advantageous developments of the invention emerge from the description and the drawings which follow.

Provision is advantageously made for the measuring arrangement to comprise an apparatus for registering those points in the fibrous web which count as broke. Suitable for this purpose are, preferably, an optical sensor which is arranged on a beam such that it can be displaced in the cross direction, or a multiplicity of optical sensors which are fitted to a crossbeam and register the entire width of the fibrous web.

According to an advantageous refinement, a cutting plan for cutting the entire reel of the fibrous web in the longitudinal and/or in the cross direction can be drawn up. An appropriate apparatus is provided for this purpose. It is therefore possible to achieve the aim of avoiding trim as far as possible and of producing as little trim as possible.

Using a system of this type, it is possible that, by way of the cutting plan, locations with defects and quality deficiencies are located within the trim or are located in the vicinity of cut edges, so that they are subsequently not printed there and the quality of the printed paper is not reduced.

A particularly advantageous embodiment of the invention comprises a computer within the system, which, during production, calculates the broke which arises when the optimum cutting plan is applied.

In this way, with the aid of the computer, the locations with quality deficiencies or with defects in the fibrous web are placed within the cutting plan in such a way that these are located in the region of the trim or in the region of the cut edges.

For the further production, the computer calculates the total production using predefined assumptions relating to broke or trim. It is sometimes clear that, for example in a specific paper zone in the cross direction of the web, an unacceptable strip is being produced and that this production problem will exist for a further time.

Under these preconditions, the computer defines the total production and the scope of the production of the fibrous web required in a computing process which runs continuously or at specific times, by using the respectively current estimate of the broke.

It is of particular advantage if the computer carries out cyclic trim optimization, which takes into account preceding and expected future production data.

This method includes the computer carrying out an extrapolation of the future production on the basis of current process states. For this purpose, there are several possibilities:

For instance, there has been a quality problem for some time in the cross direction of the machine. The method for extrapolating the broke during the production is able to assume that the defect will continue to exist.

In another example, the variability of the quality fluctuations has hitherto led to broke of a specific percentage order of magnitude. It is therefore possible to assume that this defect will continue to exist.

In a further exemplary situation, it is known that a change will soon be made to the machine which will lead to losses in terms of quality, for example a wire change, another mode of operation at the wet end of the machine, that is to say in the production and composition of the fibrous suspension. This change can be taken into account in the extrapolation.

In an advanced method, according to the invention, a distinction is not only drawn between good production and broke but the quality of the paper web produced is divided up region by region into various grades and quality classes. Such a method also takes account, in particular, of the fact that various customers have various demands with regard to the quality classes, and ensures that a sufficient quantity of the required quality is produced even for the most demanding customers.

In this case, the computer takes into account current and future data from the machine, in particular, settings and changes to the machine. Likewise, the computer is able to draw up a classification of the fibrous web produced in accordance with different quality grades or quality classes.

The machine advantageously comprises a slitter-rewinder which, on the basis of the data produced by the computer, defines the diameter, width and order of fibrous web rolls to be produced from the parent reel. The slitter-rewinder can also be arranged separately from the machine for producing the fibrous web and process a completely wound roll further. In this case, too, all the data about the quality of the web is made available to the slitter-rewinder, so that the latter defines the order and the lengths as well as the diameters of the rolls to be produced for the customers.

The trim optimization is used, for example, to optimize the longitudinal cuts in the slitter-rewinder by evaluating all the data from the quality control system, for example, about the cross profile, the thickness, the moisture content, defects in the fibrous web, etc. In this case, the useful width can be arranged optimally within the width of the parent reel. The formats of the individual rolls may be arranged within the useful widths. In this case, small defects can be placed in the region which is cut out, so that they no longer disrupt the final customer. Broke rolls can be cut specifically. At the same time, the cross cuts can also be optimized.

The lengths of the parent reels can be optimized by taking account of the defects wound in. Squaring operations can also be pre-planned. Squaring can be completed automatically. The parent reel is optimized to set lengths, that is to say to the length of the paper web in the finished roll after slitting and rewinding. The order of the sets of rolls (finished rolls) matched to customer specifications from the parent reel initially produced by the machine can be defined. In the process, defects are placed at the start or at the end of finished rolls. In this way, the number of splices within finished rolls can also be reduced considerably.

Overall, the advantages of the invention results in the reduction of broke and in the saving or reduction of the reserve production. By way of cutting out regions of lower quality, breaks in the finished rolls can be avoided. The number of splices in the finished rolls is reduced. Overall, complaints about finished rolls are ruled out or at least considerably reduced.

According to the invention, use is made of sensors which measure online and automatically, with the aid of which it is possible to determine not only the consistency or the ash content of a fibrous web but also all other measurable parameters. These are, for example, the pH, the air content of the fibrous web, its loading, moisture content and so on. All the values, together with the coordinates of the fibrous web to which the measure values belong, are fed to the computer for evaluation, so that the latter calculates the quality and deviations from a desired quality fixed for each customer.

The invention also provides for machine for producing a web comprising a system for predefining a quantity of a grade to be produced comprising a measuring arrangement for measuring quality data during production of the web, wherein the system defines the quantity of the grade to be produced by using data measured by the measuring arrangement during the production of the web.

The web may comprise one of a paper web, a board web, a tissue web, and a fibrous material web.

The measuring arrangement may comprise an apparatus for registering particular locations in the web which count as broke.

The measuring arrangement may comprise an apparatus for registering particular locations in the web having defects.

The machine may further comprise an apparatus for drawing up a cutting plan for cutting an entire reel of the web in at least one of a longitudinal direction and a crosswise direction.

The cutting plan may identify locations in the web having at least one of defects and quality deficiencies.

The cutting plan may be structured and arranged to place defects in the web are located one of in a trim area and in a vicinity of at least one cut edge.

The system may comprise a computer which, during the production, calculates broke which arises when an optimum cutting plan is utilized.

The computer may be structured and arranged to ensure that locations on the web having quality deficiencies or defects are located one of in a trim area and in a vicinity of at least one cut edge.

The computer may utilize a cutting plan. The computer may calculate an overall production under predetermined assumptions for a further production of broke or trim. The computer may define a scope of a required production of the web continuously or at specific times by using a current estimate of an overall production. The computer may carry out a cyclic trim optimization, which takes into account preceding and expected future production data. The computer may carry out an extrapolation of a future production on a basis of current process. states. The computer may takes into account current and future data from the machine, in particular settings and changes to the machine. The computer may draw up a classification of the web produced in accordance with various quality grades or quality classes.

The machine may further comprise a slitter-rewinder which, on a basis of data produced by a computer, defines a diameter, a width and an order of web rolls to be produced from a parent reel.

The invention also provides for a method for predefining a quantity of a grade to be produced using the machine described above, the method comprising measuring and recording defects of the web, determining an optimal cutting plan for the web, and utilizing the optimal cutting plan to ensure that the defects are located one of in a trim area and in a vicinity of at least one cut edge.

The method may further comprise controlling a slitter-rewinder based on the optimal cutting plan.

The invention also provide for a machine for producing a web comprising a system measuring and recording defects of the web, a system determining an optimal cutting plan for the web, and a system which utilizes the optimal cutting plan to ensure that the defects are located one of in a trim area and in a vicinity of at least one cut edge.

The invention also provides for a machine for producing a web comprising a system measuring and recording defects of the web, a system determining an optimal cutting plan for the web, a system which utilizes the optimal cutting plan to ensure that the defects are located one of in a trim area and in a vicinity of at least one cut edge, and a computer controller slitter-rewinder which implements the optimal cutting plan.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

Figure 1:
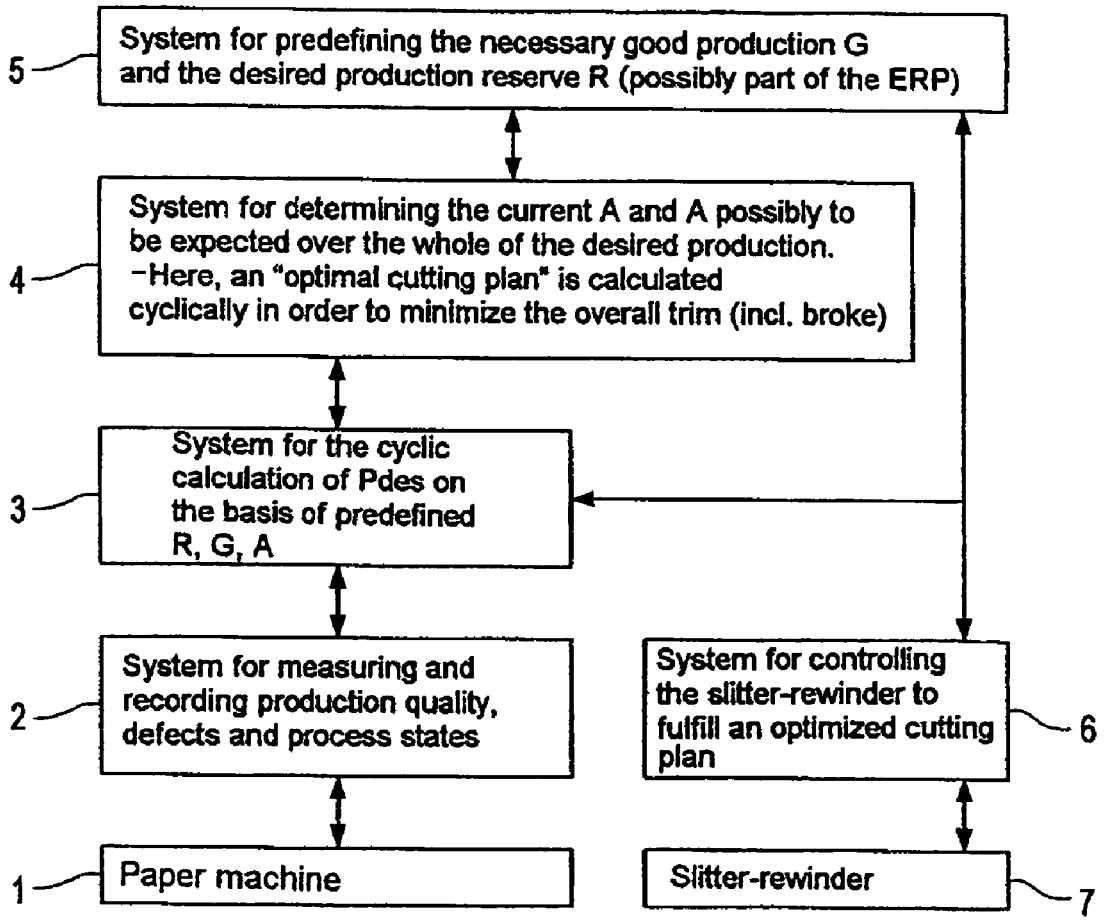
FIG. 1 shows a schematic diagram relating to determining the finished rolls on the slitter-rewinder.

FIG. 1 shows a paper machine 1 that comprises a system 2 for measuring and recording the quality of the paper web produced, including all defects. For this purpose, the machine-specific settings, that is to say the process states, are also recorded.

At specific times, preferably cyclically, the desired production, $P_{des}$, is determined on the basis of predefined values for the reserve production R, for the good production G and for the broke A. For this purpose, use is made of a system 3 for the cyclic calculation of $P_{des}$.

Furthermore, a system 4 is provided for determining the current broke A and preferably also the broke A to be expected over the whole of the production. In this case, "cyclically", an "optimal cutting plan" for cutting the paper web in the longitudinal and in the cross direction is set up. As a result, the total trim, including the broke, is minimized.

The system 4 is connected to a system 5 for predefining the necessary good production G and also a desired production reserve R. The system 5 is, for example, part of a company-wide system for determining the existing resource volumes for the production planning.

The system 5 is in turn connected to a system 6 for controlling a slitter-rewinder (RSM)7, which is used to fulfill an optimized cutting plan.

Figure 2A:
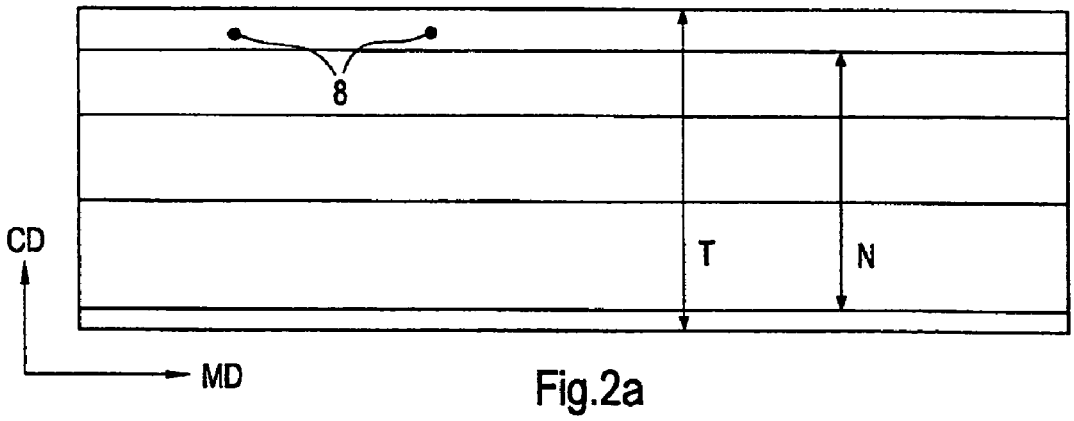
FIG. 2*a* shows the arrangement of the width N which is usable for the fibrous web within the width of the parent reel onto which this is wound.

With the aid of the system illustrated in FIG. 1, the useful width N (FIG. 2*a*) of the paper web running in the machine direction (MD) is arranged within the total width T of the parent reel extending in the cross direction CD in such a way that defects 8 no longer fall into the region of the useful width N but are cut away during cutting.

Figure 2B:
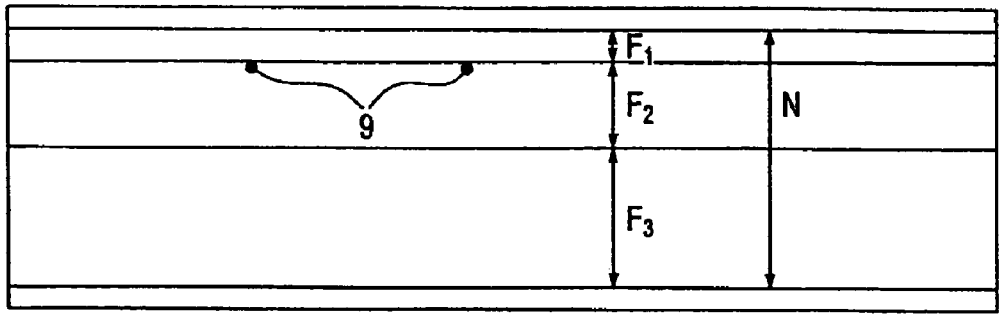
FIG. 2*b* shows the arrangement of various formats of finished rolls within the usable width.

In addition, within the useful width N (FIG. 2*b*), finished rolls with the formats $F_1$, $F_2$, $F_3$ are cut in such a way that defects or locations of lower quality 9 fall into the region of the cut edge, where they are not disruptive for the customer.

Figure 2C:
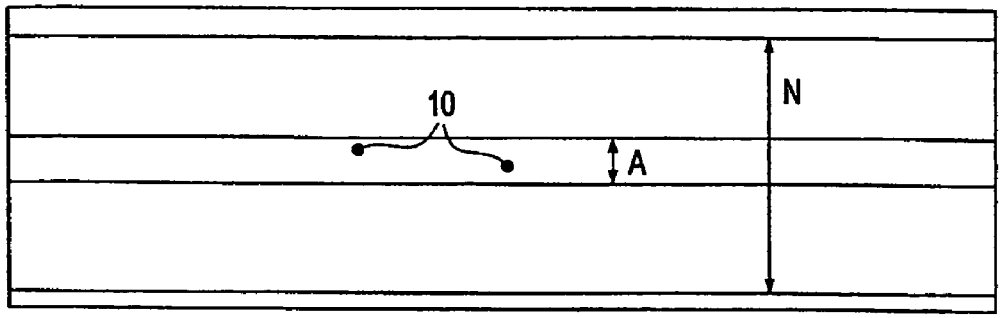
FIG. 2*c* shows the schematic diagram according to which the finished rolls within the usable width of the fibrous web are cut out of the latter.

Broke reels A (FIG. 2*c*) can also be cut specifically such that defects 10 are contained in them.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A machine for producing a web comprising:

a system for predefining a quantity of a grade to be produced comprising a measuring arrangement for measuring quality data during production of the web, wherein the system defines the quantity of the grade to be produced by using data measured by the measuring arrangement during the production of the web, and wherein the system calculates quality and deviation from a desired quality.

2. The machine of claim 1, wherein the web comprises one of a paper web, a board web, a tissue web, and a fibrous material web.

3. The machine of claim 1, wherein the measuring arrangement comprises an apparatus for registering particular locations in the web which count as broke.

4. The machine of claim 1, wherein the measuring arrangement comprises an apparatus for registering particular locations in the web having defects.

5. The machine of claim 1, further comprising an apparatus for drawing up a cutting plan for cutting an entire reel of the web in at least one of a longitudinal direction and a crosswise direction.

6. The machine of claim 5, wherein the cutting plan identifies locations in the web having at least one of defects and quality deficiencies.

7. The machine of claim 5, wherein the cutting plan is configured so that defects in the web are located at least one of in a trim area and in a vicinity of at least one cut edge.

8. The machine of claim 1, wherein the system comprises a computer which, during the production, calculates broke which arises when an optimum cutting plan is utilized.

9. The machine of claim 8, wherein the computer is structured and arranged to ensure that locations on the web having quality deficiencies or defects are located one of in a trim area and in a vicinity of at least one cut edge.

10. The machine of claim 9, wherein the computer utilizes a cutting plan.

11. The machine of claim 8, wherein the computer calculates an overall production under predetermined assumptions for a further production of broke or trim.

12. The machine of claim 8, wherein the computer defines a scope of a required production of the web continuously or at specific times by using a current estimate of an overall production.

13. The machine of claim 8, wherein the computer carries out a cyclic trim optimization, which takes into account preceding and expected future production data.

14. The machine of claim 8, wherein the computer carries out an extrapolation of a future production on a basis of current process states.

15. The machine of claim 8, wherein the computer takes into account at least one of:

current and future data from the machine; and settings and changes to the machine.

16. The machine of claim 8, wherein the computer draws up a classification of the web produced in accordance with various quality grades or quality classes.

17. The machine of claim 1, further comprising a slitter-rewinder which, on a basis of data produced by a computer, defines a diameter, a width and an order of web rolls to be produced from a parent reel.

18. The machine of claim 1, wherein the system is structured and arranged to minimize total trim.

19. A method for predefining a quantity of a grade to be produced using the machine of claim 1, the method comprising:

measuring and recording defects of the web;

determining an optimal cutting plan for the web; and at least one of:

utilizing the optimal cutting plan to ensure that the defects are located one of in a trim area and in a vicinity of at least one cut edge;

controlling a slitter-rewinder based on the optimal cutting plan.

20. A machine for producing a web comprising:

a system for measuring and recording defects on the web;

a system for determining an optimal cutting plan for the web; and a system which utilizes the optimal cutting plan to ensure that the defects are located one of in a trim area and in a vicinity of at least one cut edge.

21. A machine for producing a web comprising:

a system for measuring and recording defects of the web;

a system for determining an optimal cutting plan for the web;

a system which utilizes the optimal cutting plan to ensure that the defects are located one of in a trim area and in a vicinity of at least one cut edge; and a computer controller slitter-rewinder which implements the optimal cutting plan.

* * * * *